United States Patent [19]

Shiplee, III

[11] 4,260,185

[45] Apr. 7, 1981

[54] MACRAME DEVICES

[76] Inventor: Lewis D. Shiplee, III, 1112 S. Magnolia Dr., Apt. V-204, Tallahassee, Fla. 32301

[21] Appl. No.: 55,342

[22] Filed: Jul. 6, 1979

[51] Int. Cl.[3] ..... D04G 5/00; B65H 69/01

[52] U.S. Cl. ..... 289/16.5

[58] Field of Search ..... 289/16.5; 211/16, 86, 211/87

[56] References Cited

U.S. PATENT DOCUMENTS

| | | | |
|---|---|---|---|
| D. 245,587 | 8/1977 | Chaves | 289/16.5 X |
| 2,123,077 | 7/1938 | Mayer | 289/16.5 |
| 2,395,981 | 3/1946 | Walker | 289/16.5 |
| 3,355,030 | 11/1967 | Cathcart | 211/87 |
| 3,731,960 | 5/1973 | Pagano | 289/17 |
| 4,003,592 | 1/1977 | Schreves | 289/16.5 |
| 4,045,061 | 8/1977 | Fierro | 289/16.5 |
| 4,088,351 | 5/1978 | Roth | 289/16.5 |
| 4,109,946 | 8/1978 | Williams | 289/16.5 |
| 4,111,471 | 9/1978 | Hanley | 289/16.5 |
| 4,120,522 | 10/1978 | Rodnunsky | 289/16.5 |

*Primary Examiner*—Louis Rimrodt

*Attorney, Agent, or Firm*—Roger L. Martin

[57] ABSTRACT

A convoluted cord retainer for a macrame device has coils that are centered on an arcuate axis so that the coils touch on one side of the arrangement and are spaced apart on the other side of the arrangement. One device embodying the convoluted retainer has a support adapted with a hook for suspending the arrangement from a household door and the retainer and a holder for the macrame cords are slidably supported on an elongated rod that serves as the support component of the device. Another device utilizing the convoluted retainer has a rigid frame with spaced sides that straddle the users thigh during use, the device having a flexible connection between the sides which serves in orienting the frame in the users lap. The device here has a clamp at one end for holding the macrame cords and the convoluted retainer is located at the other end to receive and clasp the loose cord ends.

6 Claims, 14 Drawing Figures

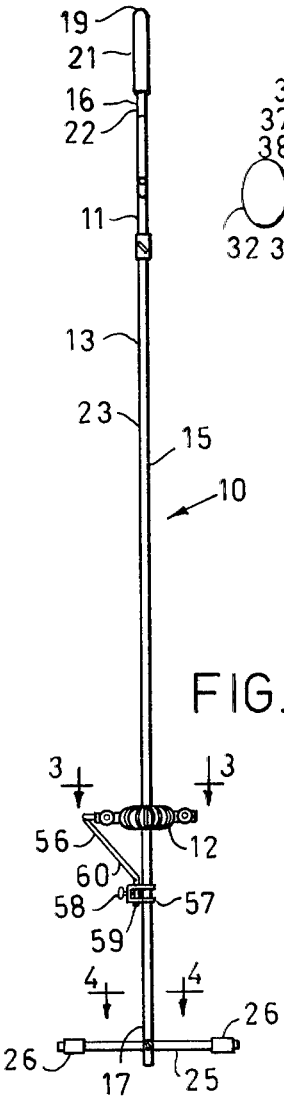
FIG.1
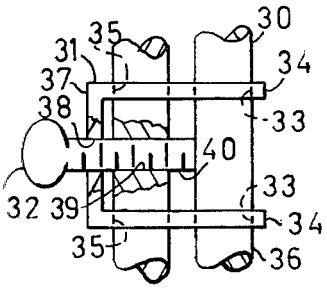
FIG. 5
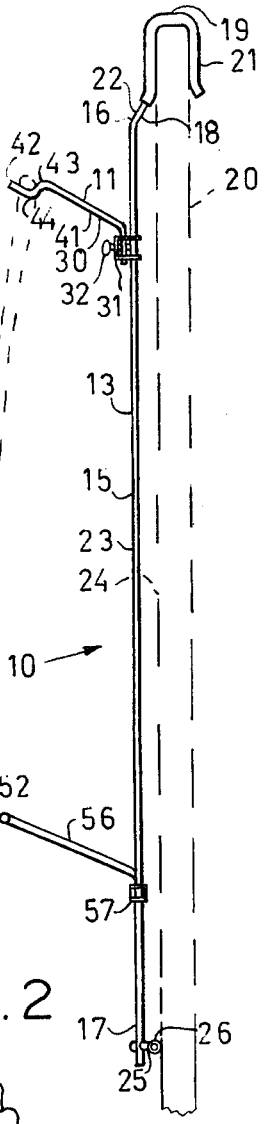
FIG. 2
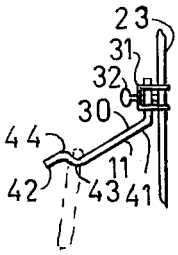
FIG. 6
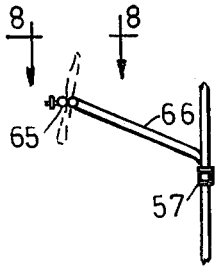
FIG. 7
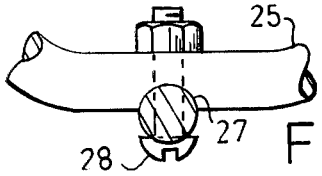
FIG. 4
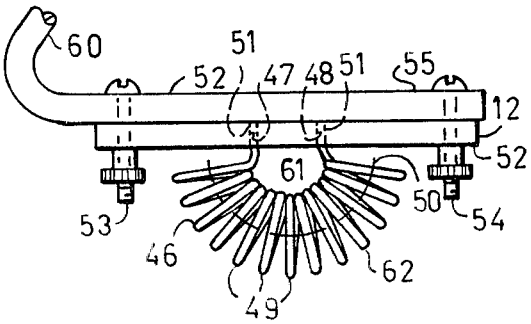
FIG. 3
FIG. 8
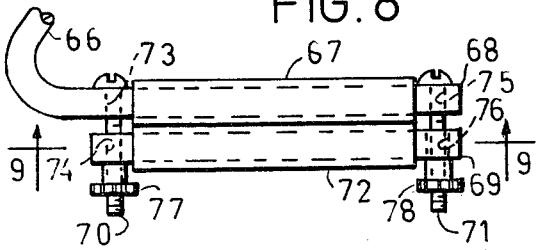
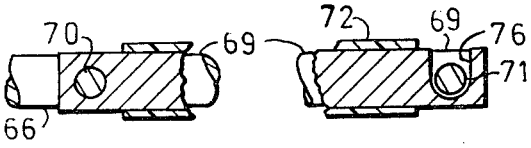
FIG.9

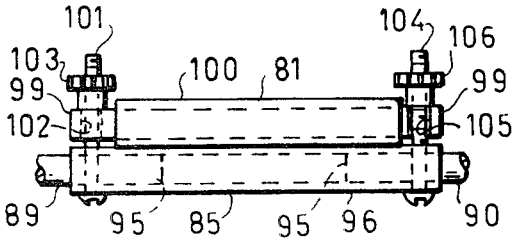
FIG. 12
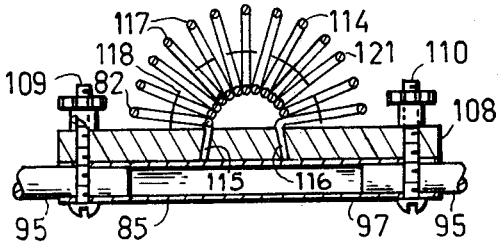
FIG. 13
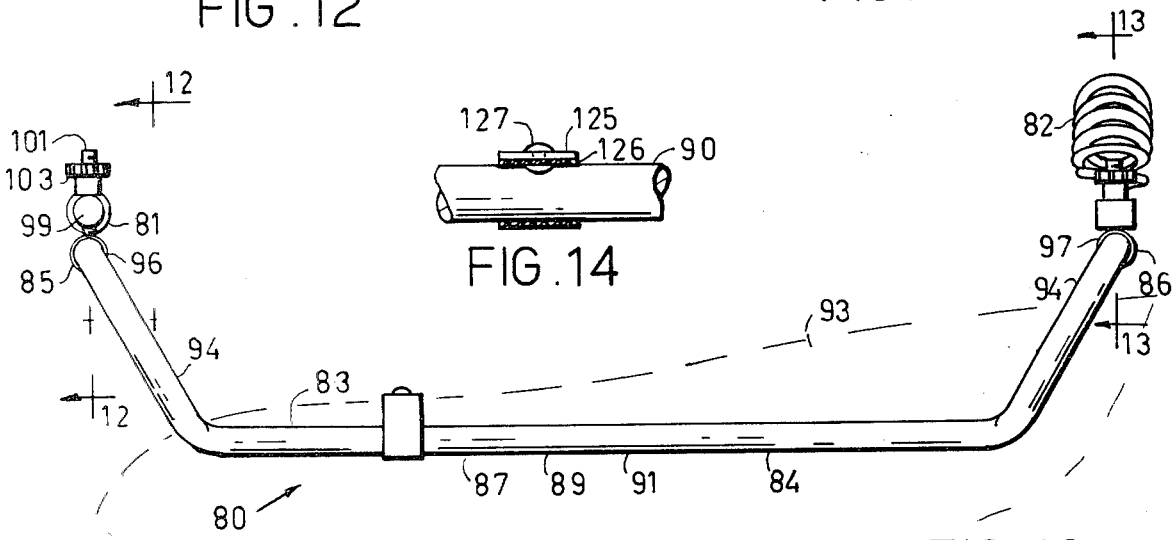
FIG. 14
FIG. 10
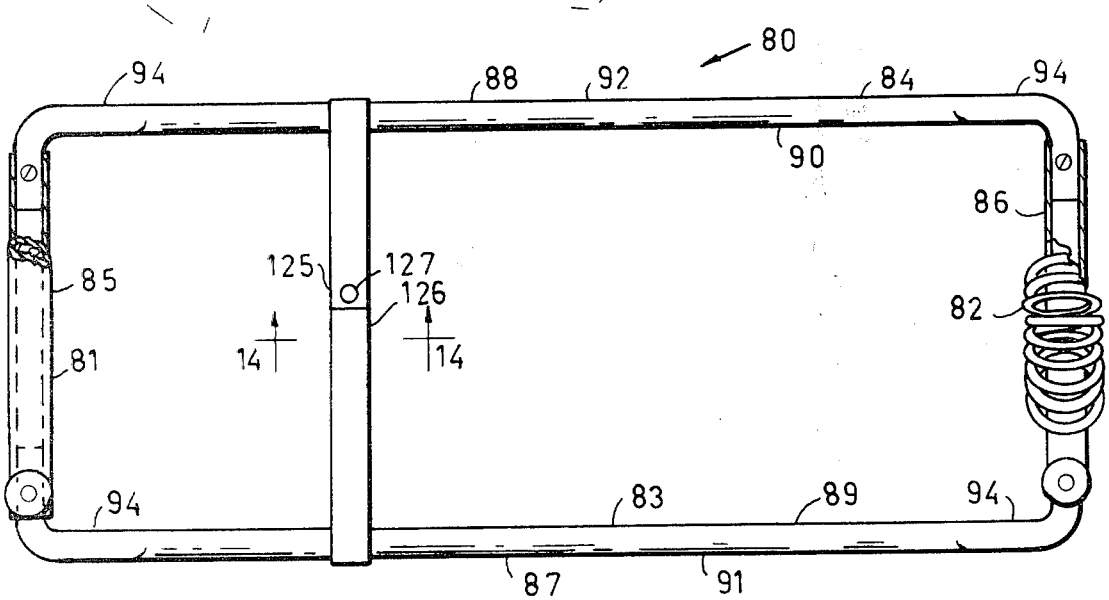
FIG. 11

MACRAME DEVICES

BACKGROUND OF THE INVENTION

The macrame art has recently become revitalized and more widely practiced than it has been in a number of years. The art involves the knotting and weaving of macrame cords and in many cases the practitioners of the art suspend the cords from chandeliers, light fixtures, or household light or gas pipes during the process of knotting and weaving the cords into the desired macrame structures.

The suspension of the macrame cords from household fixtures and the like is obviously dangerous and the need exists for suitable stands or devices that may be utilized in practicing the art. Various different macrame stands or devices have been proposed for practicing the art in the home but in most cases the devices are unsatisfactory and too complicated and costly for universal use by the practitioners of the art.

One of the problems with the weaving and knotting devices used in practicing the macrame art is attributed to the many loose ends of the macrame cords that must be temporarily retained under taut conditions as the practitioner proceeds from one group of macrame cords to the next in the practice of preparing the finished product. Various methods have been advocated for storing the loose ends including appropriately located alligator clips or slotted boards. The so-called alligator clips require the use of both hands in order to clamp the cord ends in the clip and are otherwise unsuitable in that they tend to fray the cords as the cords are repeatedly grasped and released by manipulation of the clip. The slotted boards have V-shaped slots in which the cords are jammed during their nonuse but are unsatisfactory in that the need exists for the maintenance of a high polish on the boards in order to again avoid fraying of the cords.

SUMMARY OF THE INVENTION

The invention relates to improved weaving and knotting devices for use in making macrame and which are equipped with improved cord retaining devices for releasably clasping the macrame cords during the weaving and knotting procedures.

The improvement in accord with certain aspects of the invention involves the use of a convoluted cord retention means that readily facilitates the placement of a macrame cord in a retained state that may be under tension as well as its recovery from the retainer for use in the weaving and knotting procedures. To avoid cord abrasion the convoluted cord retainer is preferably formed from an elongated coiled element of the nature of a coiled spring and wherein the coils are arranged and centered along an arcuate axis so that the coils are basically contiguous at one side of the coil arrangement so the cords can thereat be clamped between adjacent convolutions while at the opposite side of the coil arrangement the coils are spaced apart to thereby serve in guiding the macrame cords into the clamping coil arrangement at the other side of the arrangement.

One objective of the invention is to provide knotting and weaving devices which are simple and inexpensive to manufacture and may be readily employed for their intended purpose in the home. In accord with certain aspects of the invention the convoluted retainer and a cord holder are mounted on an elongated rod which is equipped with a hook at one end so as to facilitate suspension of the device from a conventional household door. The cord holder and convoluted cord retainer are slidably mounted on the elongated rod through the use of U-shaped brackets that are equipped with manipulatable devices for releasably securing the brackets against sliding movement on the rod.

Certain aspects of the invention have to do with a macrame device that is designed for use by the practitioner while seated, the support for the cord retainer and cord holder being in this instance in the form of a frame with opposite sides that are arranged to straddle the persons thigh during use of the device. The device also has an elongated flexible component which interconnects the opposite sides and which is arranged to rest on the users thigh and serve in the orientation of the device during use by the practitioner. In this case the cord holder is in the form of a clamping device that has a pivotal element which is pivotally movable with respect to a sleeve component of the frame and which is provided with a means for pressing a deformable component that is carried by the pivotal element against the sleeve component. Other aspects of the invention will be apparent from the disclosure contemplated hereinafter.

DESCRIPTION OF THE DRAWINGS

The novel features which are believed to be characteristic of this invention are set forth with particularity in the appended claims. The invention, itself, however, both as to its organization and method of operation, together with further objects and advantages thereof, may best be understood by reference to the following descriptions taken in connection with the accompanying drawings, wherein:

FIG. 1 is a front view of a macrame device embodying certain aspects of the invention;

FIG. 2 is a side elevational view of the device seen in FIG. 1;

FIG. 3 is an enlarged view of the convoluted cord retainer as generally seen along the lines 3—3 of FIG. 1;

FIG. 4 is an enlarged view taken generally along the lines 4—4 of FIG. 1;

FIG. 5 is an enlarged view of a U-shaped bracket used in mounting the retaining means with certain parts broken away;

FIG. 6 is a side elevational view of the macrame cord holder seen in FIG. 2 and as seen in a different position;

FIG. 7 is a side elevational view of a clamping device that may be utilized in lieu of the convoluted cord retainer under certain circumstances;

FIG. 8 is an enlarged plan view of the clamping device as seen along the lines 8—8 in FIG. 7;

FIG. 9 is a vertical sectional view taken generally along the lines 9—9 of FIG. 8;

FIG. 10 is a side elevational view of yet another macrame device embodying the principles of the invention;

FIG. 11 is a plan view of the device seen in FIG. 10;

FIG. 12 is a vertical view of a clamping device as seen generally along the lines 12—12 of FIG. 10;

FIG. 13 is a vertical sectional view taken generally along the lines 13—13 of FIG. 10; and FIG. 14 is a sectional view taken generally along the lines 14—14 of FIG. 11.

DESCRIPTION OF EMBODIMENTS

Reference is now made to the embodiment of the invention as seen in FIGS. 1 through 9 and wherein the device for use in making macrame structures is designated at 10. It includes a macrame cord holder 11, a convoluted cord retainer for releasably clasping the macrame cords during the process of making the macrame and a rigid support component 13 on which the holder 11 and retainer 12 are supported and mounted.

The support component 13 is shown in the form of an elongated metal rod 15 that has opposite ends 16 and 17. At its upper end 16 the end section 18 of the rod 15 is bent to provide a hook 19 that is arranged to straddle the upper end of a conventional household door 20 so that the assembled macrame device may be utilized as suspended from a conventional door structure. Section 18 is equipped with a resilient sleeve 21 of suitable material such as soft rubber so as to avoid abrasion of the door 20 and section 18 has a neck portion 22 that is bent away from the hook so that the upper end of the rod section 23 therebelow is offset from the face 24 of the door 20 when suspended therefrom. At the lower end 17 the rod 15 is equipped with a transversely arranged rod 25 that serves to space the lower end of the rod section 23 from the door face 24. This cross rod at its opposite ends is equipped with a pair of sleeves 26 of resilient material such as rubber to again avoid abrasion of the door face 24. As seen in FIG. 4, section 23 is equipped with a notch 27 that accommodates the cross rod 25 at the juncture of the two elements and is secured to the rod by means of a nut and bolt fastener 28.

The cord holder 11 in this embodiment comprises an elongated rod element 30 that is releasably secured to a U-shaped bracket 31 which is slidably mounted on and adjustably secured to rod 15 by means of a finger manipulatable screw element 32. Bracket 31 has a pair of holes 33 in its opposite legs 34 and which are aligned and arranged to accommodate the passage of the rod section 23 therethrough. The bracket also has another pair of aligned holes 35 and which accommodate the inner end portion 36 of rod 30. The bracket portion 37 intermediate the legs 34 is equipped with a threaded aperture 38 and the inner end portion of rod 30 is likewise equipped with a threaded aperture 39. The threaded shank 40 of screw element 32 extends through the threaded apertures 38 and 39 and may be screwed into forceful end contact with rod section 23 to thereby secure the bracket against sliding movement on the rod.

The inner end portion 36 of rod 30 is, as seen in FIG. 2, bent at an obtuse angle with respect to the intermediate portion 41 of rod 30 while the outer end portion 42 of rod 30 joins the intermediate portion 41 with a 90° bend 43 and is further equipped with another oppositely directed 90° bend 44. This permits the rod element 30 to serve as a hook type holder for the macrame cords when secured to the bracket 37 in either of the upwardly inclined position shown in FIG. 2 or downwardly inclined position shown in FIG. 6.

The structure of the cord retainer 12 is best seen in FIG. 3. It includes an elongated coiled metal element 46 having opposite ends 47 and 48 that are drawn together so that the coils 49 are arranged and centered along an arcuate axis 50. The element ends 47 and 48 are fixed in suitably spaced holes 51 in an elongated rod 52 that is secured at its opposite ends by means of bolt type fasteners 53 and 54 to the outer end portion 55 of a rod 56 that is utilized in connecting the retainer to another U-shaped bracket 57 which is structurally the same as bracket 31 and equipped with a screw element 58 for adjustably securing the bracket to the rod 15. Rod 56 has an inner end portion 59 which is bent at an obtuse angle with respect to the intermediate portion 60 and this inner end portion 59 is threadingly engaged by the shank of screw element 58 in a manner contemplated in discussing the inner end portion 36 of rod 30. Screw element 58 provides a manipulatable means for releasably securing the slidable bracket 57 to rod 15.

The arcuate nature of the coil arrangement is such that the coils 49 are contiguous at the inner side 61 of the arrangement and are spaced apart at the outer side 62 that is diametrically opposite the inner side in the coil arrangement. This basically permits the macrame cords to be received in the retainer through the spaces between the coils at the outer side 62 and enables the coils to guide the macrame cords into a clamping arrangement between the coils at the inner side 61 of the coil arrangement. This retainer arrangement greatly facilitates the retention of the cords and their retrieval with a minimum of abrasion.

In the use of the device 10 the cords that are to be embodied in the final macrame structure are suitably suspended from the cord holder while the ends are clamped between the coils until such time as they are withdrawn for manipulation into the form of the desired macrame structure.

For weaving procedures that require a warp of macrame cords for a woven component of the macrame design, the convoluted cord retaining assembly 12 may be replaced by a clamping device 65 which is designed to receive and hold the cords in a laterally spaced relation. The clamping device 65 may be attached to bracket 57 by first removing screw element 58 from rod 56 so as to facilitate removal of the rod 56 from the bracket 57.

The clamping device 65 comprises a rod 66 that is identical to rod 56 and which carries a resilient sleeve 67 of suitable material such as a soft rubber over its outer end portion 68. Device 65 also has another elongated rod 69 which at one end is pivotally connected to the outer end portion 68 by means of a bolt type fastener 70 that provides an axis for pivotal movement of the rod 69 with respect to the end portion 68. Rod 69 also has a resilient sleeve 72 which surrounds the rod 69 between fastener 70 and yet another bolt type fastener 71 that is used in cooperation with fastener 70 to draw the rod 69 into clamping relation with the outer end portion 68 of rod 66. The shank of bolt 70 extends through appropriately aligned holes 73 and 74 in end portion 68 and rod 69 and the shank of bolt type fastener 71 extends through a hole 75 in end portion 68 and through a laterally opening slot 76 at the end of rod 69. This arrangement enables the rod 69 to be pivoted into parallel with the outer end portion 68 and thus in a position at which the nuts of the fasteners 70 and 71 may be manipulated to draw the elements into a clamping arrangement.

In substituting the clamping device for the convoluted cord retainer, the rod 56 is first removed from the bracket 57. Thereafter the inner end portion of rod 66 is inserted in the holes that accommodate end portion 59 of rod 56 and screw element 58 is threaded through the threaded holes in the bracket and inner end portion (not shown) of rod 66 and until the screw element 58 comes into forceful end contact with the support rod section 23 to thereby secure the bracket against sliding movement on the support rod.

When the clamping device 65 is properly oriented with respect to the cord holder 11 the cords forming the warp may be suspended from the cord holder and therebelow clamped in proper spaced relation in clamping device 65. This may be accomplished by first manipulating the nuts 77 and 78 of fasteners 70 and 71 so as to release rod 69 and permit it to fall free of fastener 71. The cords will then be oriented against the surface of sleeve 67 and rod 69 is caused to pivot to a position at which the shank of fastener 71 is engaged in slot 76 and with the spaced cord position between the sleeve 67 and 72. At this point the nuts 77 and 78 may be manipulated to forcefully clamp the cords between the sleeves and thus maintain their position for the weaving process.

Reference is now made to the embodiment illustrated in FIGS. 10 through 14 and wherein a macrame device embodying the principles of the invention is shown in a form that is adapted to rest on the thigh of a seated person and is thus more or less supported in the lap of the seated person. The device 80 includes a cord holder 81 which in the embodiment is shown in the form of a clamping device, a convoluted cord retainer 82 like that illustrated in the previous embodiment and a rigid support component 83 that supports the holder and retainer in the assembled device 80.

The support component 83 is shown in the form of an elongated rigid open frame 84 that has opposite ends 85 and 86 and opposite sides 87 that are located and generally extend between the opposite ends. The frame 84 is made up of a pair of elongated rods 89 and 90 and these rods have parallel intermediate sections 91 and 92 that form the opposite sides 87 and 88 of frame 84 and are spaced apart to therebetween accommodate the thigh 93 of a person using the device. Each of the rods 89 and 90 is equipped with a pair of inclined rod sections 94 at the opposite ends of the intermediate sections and with opposite end sections 95 at the end extremities of the rod components 89 and 90. The opposite ends 85 and 86 of the frame 84 are formed by a pair of elongated metal sleeves 96 and 97 that are transversely arranged and located at the opposite ends respectively. The end sections 95 of the rods 89 and 90 at each end of the frame 84 are received in the open ends of the sleeve thereat and are secured in the rigid frame arrangement by means of the bolt type fasteners used in securing the clamping device and cord retainer to the frame as will be subsequently seen.

The cord holder 81 in this instance is shown in the form of a clamping device that includes a sleeve 96 and a pivotally elongated rod element 99 which carries a resilient sleeve 100 of suitable resilient material such as rubber. Element 99 is pivotally mounted to the frame by means of bolt type fastener 101 and which extends transversely through one end of the sleeve 96 as well as the end section 95 of rod 89 that is housed in the open end of the sleeve and thence through the hole 102 in element 99. (See FIG. 12) The fastener 101 is equipped with a nut 103 and at the other end of rod element 99 sleeve 96 is joined to the adjacent end of rod 90 by another bolt type fastener 104, the shank in this case of the fastener 104 extending through the end of sleeve 96 and the intervening end section 95 of rod 90 and thence through a laterally opening slot 105 that extends transversely through a rod element 99. Fastener 104 is also equipped with a finger manipulatable nut 106.

When the clamping device is used to secure macrame cords in place, nuts 103 and 106 of fasteners 101 and 104 are loosened so that element 99 can pivotally swing about the axis of fastener 101 and the macrame cords to be clamped may be placed on the metal sleeve 96. Once this is done, element 99 is pivoted back to the point at which the shank of fastener 104 is engaged in the slot 105 and nuts 103 and 106 are screwed down to force the rubber sleeve 101 that is carried by element 99 into clamping relationship with respect to the metal sleeve 96 and thus to clamp the macrame cords between sleeve 96 and 100.

The convoluted cord retainer 83 in this instance is structurally and functionally the same as the one described in the first embodiment. It includes an elongated metal bar element 108 which is rectangular in cross section and securely fastened to the end sleeve 97 by means of bolt type fasteners 109 and 110 which at the opposite ends of the bar 108 extend transversely through the sleeve 97 and rod end section 95 thereat as well as through an appropriate hole in the end of the bar. Fasteners 109 and 110 are equipped with finger manipulatable nuts 111 and 112 and which are obviously used to rigidly clamp the bar 108 to the frame component 97 and 95.

Like the previously described convoluted retainer, retainer 82 includes an elongated coiled metal element 114 that has opposite ends 115 and 116. These ends 115 and 116 are drawn together in the structure so that the coils 117 are arranged and centered along an arcuate axis 118. The element ends 115 and 116 are fixed in suitably spaced holes 119 in the elongated rod or bar 108 that is secured to the frame by means of the fasteners 109 and 110.

The arcuate nature of the coil arrangement is again such that the coils 117 are contiguous at the inner side 120 of the arrangement and are spaced apart at the outer side 121 that is diametrically opposite the inner side. This retainer arrangement again greatly facilitates retention of the cords and their retrieval with a minimum of effort and damage to the cords due to abrasion.

The embodiment shown in FIGS. 10 through 14 is designed to straddle the thigh of a seated user of the device and to aid in orientation of the device during the use, the device is equipped with an elongated flexible band or strap 124 that interconnects the parallel sections 91 and 92 of rods 89 and 90 and in an arrangement where it is adapted to rest on the persons thigh which is being straddled between the sections. The elongated element may be simply wrapped around the sections 91 and 92 between the frame end, and the opposite ends 125 and 126 may be secured together by a conventional snap 127 having a male member mounted on one of the ends and a cooperating female member on the other end of the strap.

While only certain preferred embodiments of this invention have been shown and described by way of illustration, many modifications will occur to those skilled in the art and it is, therefore, desired that it be understood that it is intended herein to cover all such modifications that fall within the true spirit and scope of this invention.

What is claimed as new and what it is desired to secure by Letters Patent of the United States is:

1. A macrame device comprising a rigid support component, a macrame cord holder mounted on and supported by said component, and convoluted cord retaining means for releasably clasping macrame cords, said retaining means being offset from said cord holder and being mounted on and supported by said component, and said retaining means comprising an elongated coiled element with coils arranged and centered along an arcuate axis so that the coils are contiguous at one side of the coil arrangement and spaced apart at the diametrically opposite side of the coil arrangement.

2. A macrame device in accord with claim 1 wherein said support component comprises an elongated rod having opposite ends and a hook at one of said ends for use in suspending the device from a door, said cord holder is slidably adjustably mounted on said rod, and said retaining means is slidably adjustably mounted on said rod.

3. A macrame device in accord with claim 2 wherein said support component comprises spacer means arranged at the other of the elongated rod ends to maintain the rod spacedly offset from the door face when suspended therefrom, said cord holder comprises a U-shaped bracket that is slidably mounted on said elongated rod, and means manipulatable in releasably secure the bracket against such sliding movement on the rod, and said cord retaining means comprises a second U-shaped bracket slidably mounted on said rod and means manipulatable to releasably secure the second bracket against such sliding movement on the rod.

4. A macrame device in accord with claim 1 wherein the rigid support component comprises an elongated rigid frame having opposite ends and opposite sides that are located between said opposite ends, said frame comprising a pair of elongated rods having parallel sections which respectively form said opposite sides and are spaced apart to therebetween accommodate and straddle the thigh of a person using the device, and wherein said device comprises elongated flexible means interconnecting said parallel sections and arranged to rest on the persons thigh straddled therebetween.

5. A macrame device comprising a rigid support component, a macrame cord holder mounted on and supported by said component, and convoluted cord retaining means for releasably clasping macrame cords, said retaining means being offset from said cord holder and being mounted on and supported by said component, said rigid support component comprising an elongated rigid frame having opposite ends and opposite sides that are located between said opposite ends, said frame comprising a pair of elongated rods having parallel sections which are spaced apart and respectively form said opposite sides, and a pair of elongated sleeves that are transversely arranged and respectively located at said opposite ends, each of said rods having opposite end sections and each of said sleeves being receptive of the rod end sections at its frame end, and said cord holder comprising a clamping device that includes an elongated element which is mounted for pivotal movement with respect to one of said sleeves, resiliently deformable means carried by said element, and means cooperating with said element for pressing said deformable means against said one of said sleeves.

6. A macrame device in accord with claim 5 wherein the convoluted cord retaining means comprises an elongated coiled element with coils arranged and centered along an arcuate axis so that the coils are contiguous at one side of the coil arrangement and spaced apart at the diametrically opposite side of the coil arrangement.

* * * * *